US009039120B2

(12) United States Patent
Nishioka

(10) Patent No.: US 9,039,120 B2
(45) Date of Patent: May 26, 2015

(54) INKJET PRINTING APPARATUS AND INKJET PRINTING METHOD

(71) Applicant: CANON KABUSHIKI KAISHA, Tokyo (JP)

(72) Inventor: Shingo Nishioka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/162,983

(22) Filed: Jan. 24, 2014

(65) Prior Publication Data

US 2014/0218427 A1 Aug. 7, 2014

(30) Foreign Application Priority Data

Feb. 5, 2013 (JP) ..... 2013-020586

(51) Int. Cl.
*B41J 29/38* (2006.01)
*B41J 19/14* (2006.01)

(52) U.S. Cl.
CPC ..... *B41J 19/145* (2013.01)

(58) Field of Classification Search
USPC ..... 347/5, 9, 14, 15, 41
See application file for complete search history.

(56) References Cited

U.S. PATENT DOCUMENTS 6,629,743 B2 10/2003 Chikuma et al.
6,805,422 B2 * 10/2004 Takahashi et al. ..... 347/15
7,823,999 B2 * 11/2010 Ushigome ..... 347/14
8,622,501 B2 1/2014 Komamiya et al.
8,636,334 B2 1/2014 Nishioka et al.

FOREIGN PATENT DOCUMENTS

JP 4006198 B2 11/2007

* cited by examiner

*Primary Examiner* — Lam S Nguyen
(74) *Attorney, Agent, or Firm* — Fitzpatrick, Cella, Harper & Scinto

(57) ABSTRACT

An apparatus includes a print head having a plurality of nozzle arrays; a scanning unit configured to perform scanning of the print head in a first direction and in a second direction; an adjusting unit configured to adjust an amount of the ink ejection from a first nozzle unit including a predetermined number of nozzles arranged at one of end positions of a first nozzle array, the number of nozzle arrays arranged at a side of the first direction from the first nozzle array is less than the number of nozzle arrays arranged at a side of the second direction from the first nozzle array; and a control unit. The adjusting unit adjusts the amount of the ink ejection such that amount of ink ejection in the scan of the first direction is smaller than amount of ink ejection in the scan of the second direction.

20 Claims, 14 Drawing Sheets

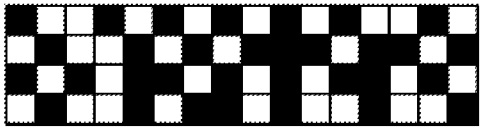
FIG.11A 50%
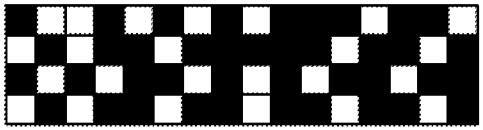
FIG.11B 37.5%
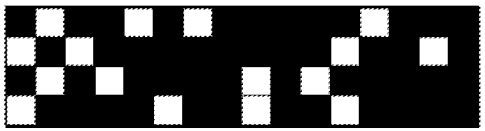
FIG.11C 25%
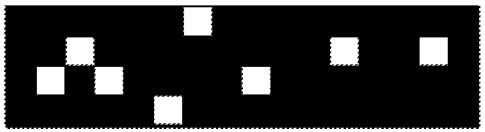
FIG.11D 12.5%
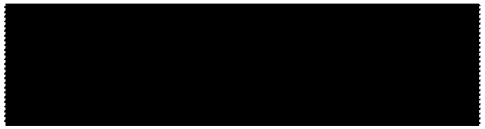
FIG.11E 0%
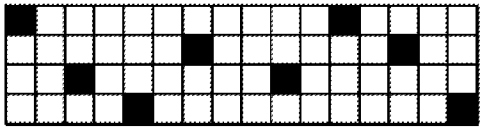
FIG.11F 12.5%
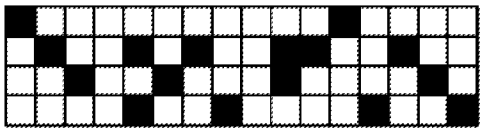
FIG.11G 25%
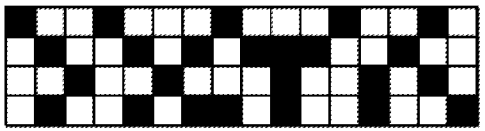
FIG.11H 37.5%
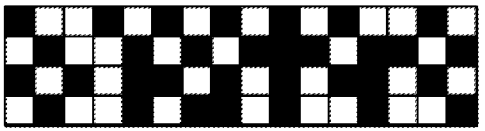
FIG.11I 50%

INKJET PRINTING APPARATUS AND INKJET PRINTING METHOD

BACKGROUND OF THE INVENTION

1. Field of the Invention

The present invention relates to an inkjet printing apparatus and an inkjet printing method, and in particular, to an inkjet printing apparatus and an inkjet printing method that can restrict generation of a connecting streak between bands.

2. Description of the Related Art

In an inkjet printing apparatus, there is known a method of printing an image by scanning a predetermined printing area (band) by one time or plural times (one pass or multi-pass). According to this printing method, there are some cases where a streak is generated in a connecting section between bands (hereinafter, called "a connecting streak").

For restricting generation of this connecting streak, Japanese Patent No. 4006198 discloses a method of thinning out print data corresponding to the connecting section. In this method, the print data are thinned out based upon a sum of ink amounts used for printing or the data number corresponding to each ink.

Incidentally the connecting streak is subjected to influences of not only the sum of ink amounts used for printing and the data number corresponding to each ink but also a self-air stream generated at the time of ejecting ink and an inflow air stream generated at the time of transfer of a carriage at scanning. Therefore, according to the method of thinning out the print data by focusing attention on the sum of ink amounts used for printing and the data number corresponding to each ink alone, which is disclosed in Japanese Patent Publication No. 4006198, there are some cases where it is not possible to appropriately prevent the generation of the connecting streak.

SUMMARY OF THE INVENTION

The present invention provides an inkjet printing apparatus and an inkjet printing method that are capable of restricting generation of a connecting streak.

In a first aspect of the present invention, there is provided an inkjet printing apparatus for printing an image by ejecting ink including: a print head in which a plurality of nozzle arrays, in each of which a plurality of nozzles for ejecting ink are arranged in a predetermined direction, are arranged in a direction crossing the predetermined direction; a scanning unit configured to perform scanning by the print head in a first direction crossing the predetermined direction and in a second direction which is opposite to the first direction, while causing the print head to eject ink; an adjusting unit configured to adjust an amount of the ink ejection from a first nozzle unit which is consisted from predetermined number of nozzles arranged in one of end positions in the predetermined direction of a first nozzle array, wherein the number of nozzle arrays arranged in a side of the first direction from the first nozzle array in the plurality of nozzle array is lower than the number of nozzle arrays arranged in a side of the second direction from the first nozzle array in the plurality of nozzle array; and a control unit configured to control the print head so as to eject ink from the first nozzle unit according to the amount of the ink ejection adjusted by the adjusting unit, wherein the adjusting unit adjusts the amount of the ink ejection from the first nozzle unit such that amount of ink ejection from the first nozzle unit in a case that the scanning unit performs scanning by the print head in the first direction is smaller than amount of ink ejection from the first nozzle unit in a case that the scanning unit performs scanning by the print head in the second direction.

In a second aspect of the present invention, there is provided an inkjet printing apparatus for printing an image by ejecting ink including: a print head in which a plurality of nozzle arrays, in each of which a plurality of nozzles for ejecting ink are arranged in a predetermined direction, are arranged in a direction crossing the predetermined direction; a scanning unit configured to perform scanning by the print head in a first direction crossing the predetermined direction and in a second direction which is opposite to the first direction, while causing the print head to eject ink; an adjusting unit configured to adjust an amount of the ink ejection from a first nozzle unit which is consisted from predetermined number of nozzles arranged in one of end positions in the predetermined direction of a first nozzle array, wherein the first nozzle array is arranged in a position where an air stream flowing between the print head and a print medium at the time of causing the print head to scan in the first direction is stronger than an air stream flowing between the print head and the print medium at the time of causing the print head to scan in the second direction; and a control unit configured to control the print head so as to eject ink from the first nozzle unit according to the amount of the ink ejection adjusted by the adjusting unit, wherein the adjusting unit adjusts the amount of the ink ejection from the first nozzle unit such that amount of ink ejection from the first nozzle unit in a case that the scanning unit performs scanning by the print head in the first direction is smaller than amount of ink ejection from the first nozzle unit in a case that the scanning unit performs scanning by the print head in the second direction.

In a third aspect of the present invention, there is provided an inkjet printing method for printing an image by ejecting ink including: a scanning step for causing a print head, in which a plurality of nozzle arrays, in each of which a plurality of nozzles for ejecting ink are arranged in a predetermined direction, are arranged in a direction crossing the predetermined direction, to scan in a first direction crossing the predetermined direction and in a second direction which is opposite to the first direction while causing the print head to eject ink; an adjusting step for adjusting an amount of the ink ejection from a first nozzle unit which is consisted from predetermined number of nozzles arranged in one of end positions in the predetermined direction of a first nozzle array, wherein the number of nozzle arrays arranged in a side of the first direction from the first nozzle array in the plurality of nozzle array is lower than the number of nozzle arrays arranged in a side of the second direction from the first nozzle array in the plurality of nozzle array; and a control step for controlling the print head so as to eject ink from the first nozzle unit according to the amount of the ink ejection adjusted in the adjusting step, wherein in the adjusting step, the amount of the ink ejection from the first nozzle unit is adjusted such that amount of ink ejection from the first nozzle unit in the scan of the first direction is smaller than amount of ink ejection from the first nozzle unit in the scan of the second direction.

According to the above configuration, it is possible to restrict not only generation of the connecting streak due to an ink amount but also generation of the connecting streak due to a difference in an influence of a self-air stream or inflow air stream for each scanning direction.

Further features of the present invention will become apparent from the following description of exemplary embodiments (with reference to the attached drawings).

BRIEF DESCRIPTION OF THE DRAWINGS

FIG. 11A is a diagram showing a thinning-out mask;

FIG. 11B is a diagram showing a thinning-out mask;

FIG. 11C is a diagram showing a thinning-out mask;

FIG. 11D is a diagram showing a thinning-out mask;

FIG. 11E is a diagram showing a thinning-out mask;

FIG. 11F is a diagram showing an additional mask;

FIG. 11G is a diagram showing an additional mask;

FIG. 11H is a diagram showing an additional mask;

FIG. 11I is a diagram showing an additional mask;

DESCRIPTION OF THE EMBODIMENTS

Hereinafter, embodiments of the present invention will be in detail explained with reference to the accompanying drawings.

(First Embodiment)

Figure 1A:
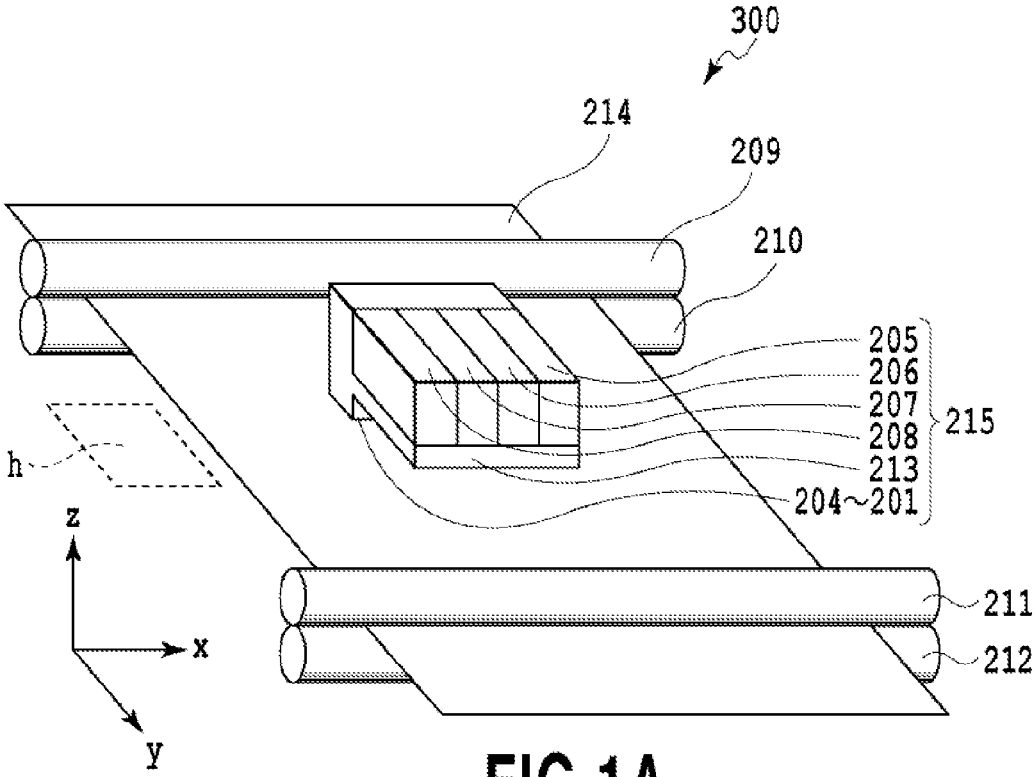
FIG. 1A is a schematic perspective view showing an inkjet printing apparatus in an embodiment according to the present invention.
Figure 1B:
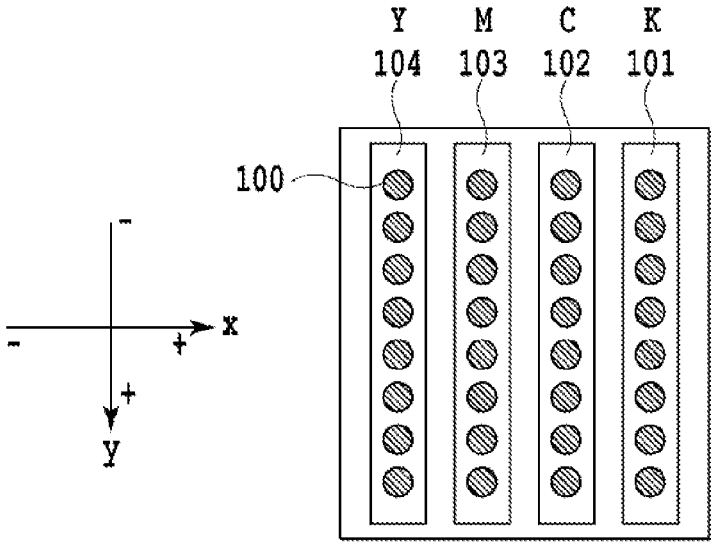
FIG. 1B is a pattern diagram showing nozzle arrays of a print head.

First, the configuration of an inkjet printing apparatus 300 (hereinafter, called a printing apparatus 300) according to a first embodiment will be explained. FIG. 1A is a schematic perspective view showing the printing apparatus 300 according to the present embodiment, and FIG. 1B is a pattern diagram showing nozzle arrays 101 to 104 of print heads 201 and 204 according to the present embodiment. It should be noted that FIG. 1B shows the nozzle arrays 101 to 104 as transparently viewed from a mount side of ink tanks 205 to 208 shown in FIG. 1A. As shown in FIG. 1A, the inkjet printing apparatus 300 is provided with a printing unit 215, a conveying roller 210, an auxiliary roller 209, a conveying roller 212, and an auxiliary roller 211.

The printing unit 215 ejects ink while reciprocating in a main scanning direction (x direction shown in FIG. 1A) crossing a conveying direction (sub scanning direction and y direction shown in FIG. 1A) of a print medium 214, thereby printing an image on the print medium 214.

The printing unit 215 is provided with a carriage 213, on which the plurality of ink tanks 205 to 208 are mounted in such a manner as to be able to supply ink to a plurality of print heads 201 to 204 of the carriage 213. Black ink (K) is accommodated in the ink tank 205, cyan ink (c) is accommodated in the ink tank 206, magenta ink (M) is accommodated in the ink tank 207, and yellow ink (Y) is accommodated in the ink tank 208.

As shown in FIG. 1B, a plurality of nozzles 100 are provided respectively in the nozzle arrays 101 to 104 which are arranged in the print heads 201 to 204 respectively. As shown in the same figure, in the present embodiment, an array direction of the nozzles 100 forming each nozzle array is positioned along a sub scanning direction (y direction shown in FIG. 1B) which is a predetermined direction.

Black ink is ejected from the nozzle 100 in the nozzle array 101, cyan ink is ejected from the nozzle in the nozzle array 102, magenta ink is ejected from the nozzle 100 in the nozzle array 103, and yellow ink is ejected from the nozzle 100 in the nozzle array 104. That is, in the present embodiment, the different ink is ejected from the nozzle in each nozzle array.

In the present embodiment, the print heads 201 to 204 respectively have the nozzle arrays 101 to 104, but the print head which can be used in the present invention may have a plurality of nozzle arrays.

It should be noted that in the present embodiment, the ink tanks 205 to 208 and the print heads 201 to 204 are mounted on the carriage 213 to be respectively separable. However, the ink tank and the print head in the present invention are not limited to this configuration, and a cartridge in which the ink tanks 205 to 208 and the print heads 201 to 204 are united may be mounted on the carriage 213. Further, a one-piece type head for plural colors which can eject inks of plural colors from a single print head may be mounted on the carriage 213.

The conveying roller 210 and the conveying roller 212 nip the print medium 214 together with the auxiliary roller 209 and the auxiliary roller 211, the conveying roller 210 and the conveying roller 212 rotate, and serve to convey, as well as hold the print medium 214. The conveying roller 210 and the auxiliary roller 209 are provided in the upstream side in the conveying direction, that is, in the feed direction side, and the conveying roller 212 and the auxiliary roller 211 are provided in the downstream side in the conveying direction, that is, in the discharge direction side.

Next, the reciprocal scan by the printing unit 215 will be explained with reference to FIG. 1A. At a non-printing time, the printing unit 215 is controlled to wait at a home position h shown in FIG. 1A. The print heads 201 to 204, upon receiving input of a print start command, move in a direction (herein, defined as a forward direction, that is, a first direction) away from the home position h in a main scanning direction (x direction shown in FIG. 1A) together with the printing unit 215. The print heads 201 to 204 eject inks from the nozzles with this movement to print on the print medium 214 (forward scan).

The printing unit 215 which has moved to a printing area of the print medium 214 moves in a direction (herein, defined as a backward direction, that is, a second direction) of being closer to the home position h which is the opposite direction this time, while ejecting inks to print on the print medium 214 (backward scan).

Before start of the next scan after completion of the previous scan, the conveying roller 210 and the conveying roller 212 rotate, and thereby the print medium 214 is conveyed in the conveying direction. At this time, the auxiliary roller 209 and the auxiliary roller 211 assist in the movement of the conveying roller 210 and the conveying roller 212. These conveying units convey the print medium 214 relative to the print head in such a manner that the nozzle in one of end portion areas of the nozzle array in a predetermined scan and the nozzle of the other end portion area in a scan after the predetermined scan respectively eject inks on adjacent areas of the print medium 214 in the conveying direction.

In this way, the print heads 201 to 204 are caused to move along the x direction, while repeating an operation of ejecting ink from the nozzle and an operation of conveying the print medium 214 in the conveying direction. By doing so, printing is performed on the print medium 214.

The printing operation of ejecting inks from the print heads 201 to 204 is performed by driving the print heads 201 to 204 by head drivers 306 to 309 based upon control by a control unit 301 (adjusting unit and control unit) to be described later. The operation of conveying the print medium 214 is performed with rotation of the conveying roller 210 and the conveying roller 212 by driving a conveying motor 310 by a motor driver 304 based upon control by the control unit 301 to be described later.

Figure 2:
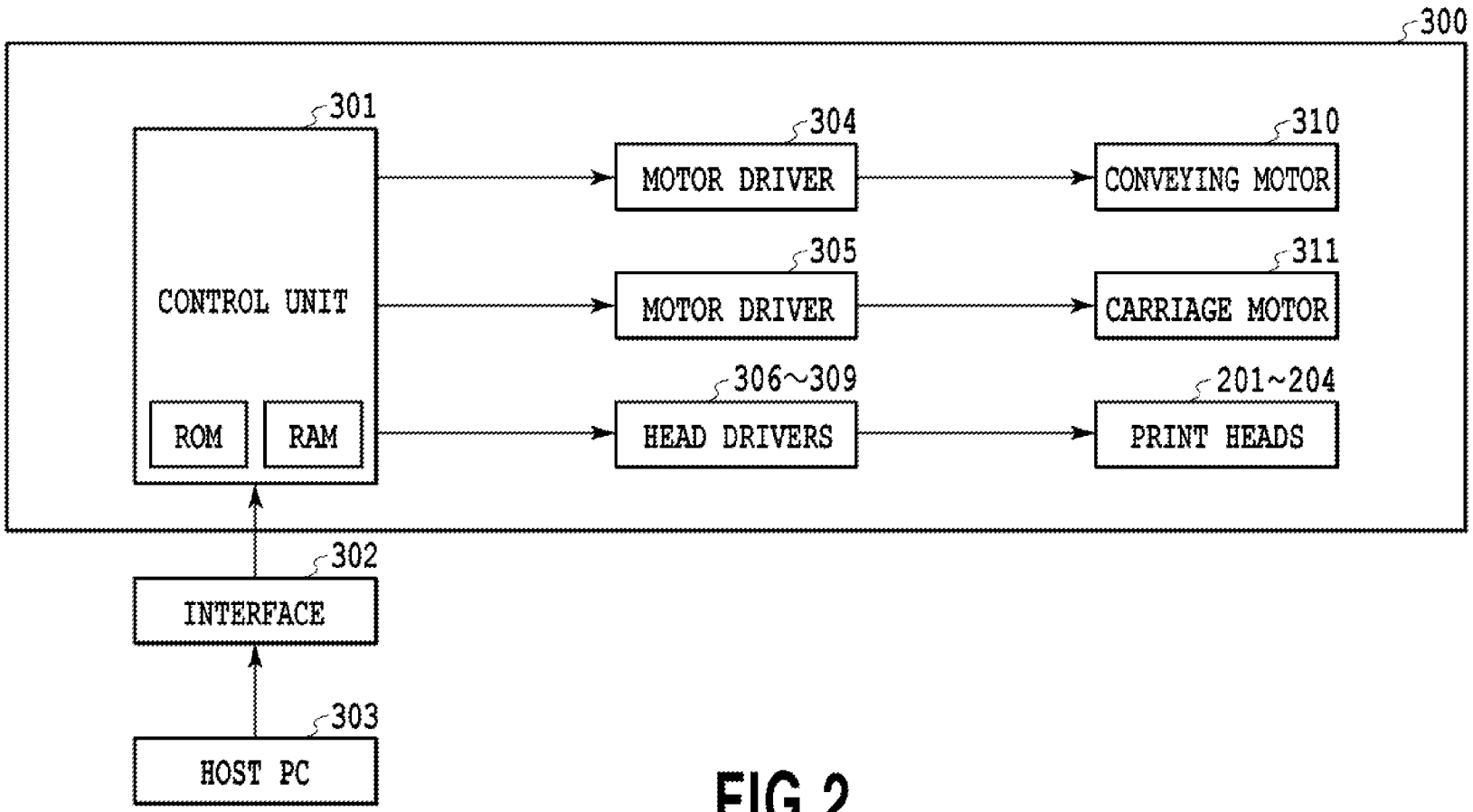
FIG. 2 is a block diagram showing an outline of the control configuration in the inkjet printing apparatus.

FIG. 2 is a block diagram schematically showing the control configuration of the printing apparatus 300 of the present embodiment. As shown in the same figure, the printing apparatus 300 is connected via an interface 302 to a host computer (hereinafter referred to as "host PC") 303. The host PC 303 is a data supply device which supplies image data and the like to the printing apparatus 300. As shown in FIG. 2, the printing apparatus 300 includes the control unit 301, the motor driver 304, the motor driver 305, the head drivers 306 to 309, the conveying motor 310, the carriage motor 311, the print heads 201 to 204 and the like.

The control unit 301 uses a RAM as a work area according to a control program stored in a ROM to perform control of an entire printing apparatus. Tables and thinning-out masks specific to the present embodiment as described later in addition to the control program are also stored in the ROM.

The control unit 301 controls the motor driver 304, the motor driver 305, the head drivers 306 to 309 and the like. Control signals related to a variety of data, printing, and the like are input through the interface 302 from the host PC 303 to the control unit 301. The control unit 301 performs various processing to the input image data to generate print data which will be printed by the print heads 201 to 204. The control unit 301 controls the motor driver 304, the motor driver 305, and the head drivers 306 to 309 according to the input control signal.

The motor driver 304 drives the conveying motor 310, and the motor driver 305 drives the carriage motor 311. The conveying motor 310 rotates the conveying roller 210 and the conveying roller 212 for conveyance of the print medium 214. When the conveying roller 210 and the conveying roller 212 rotate, the print medium 214 is conveyed in a direction which is a predetermined direction. The carriage motor 311 reciprocally moves the carriage 213 in the x direction.

The head drivers 306 to 309 drive the print heads 201 to 204, each corresponding to one print head. That is, the head drivers are provided to correspond to the number of the print heads. The control of each nozzle of the print heads 201 to 204 is performed by driving the print heads 201 to 204 respectively by the head drivers 306 to 309 based upon control from the control unit 301.

Figure 3A:
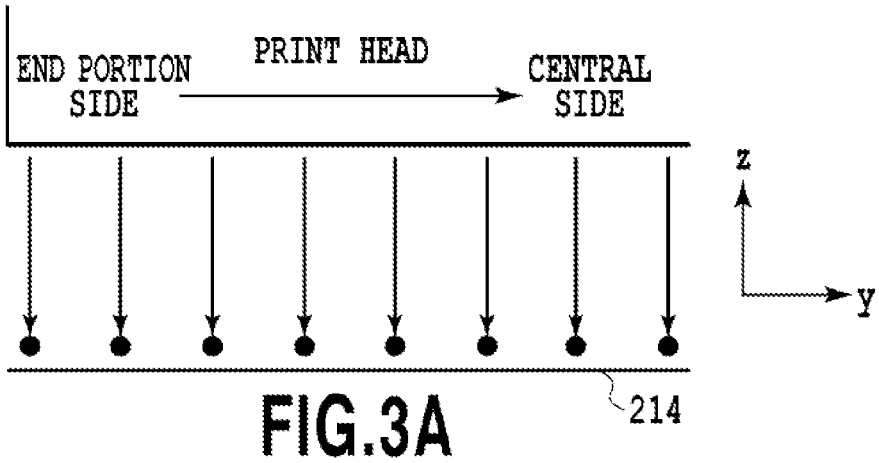
FIG. 3A is a diagram showing a relation between an ejection amount and a print position of ink.
Figure 3B:
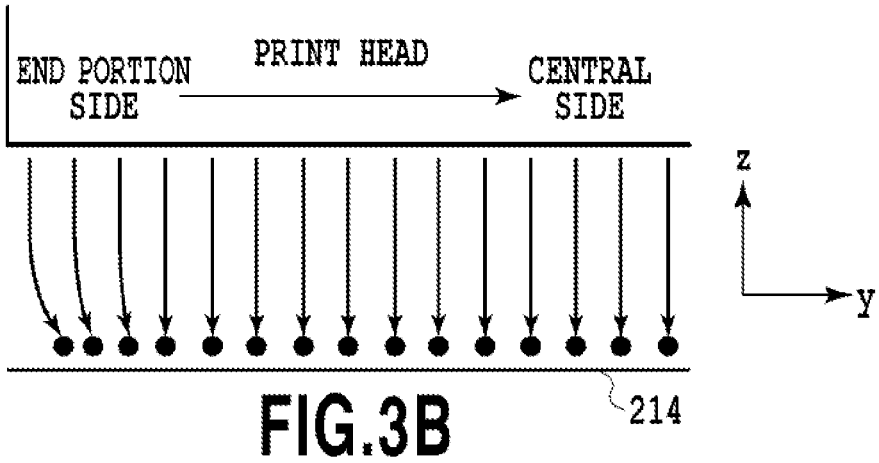
FIG. 3B is a diagram showing a relation between an ejection amount and a print position of ink.
Figure 3C:
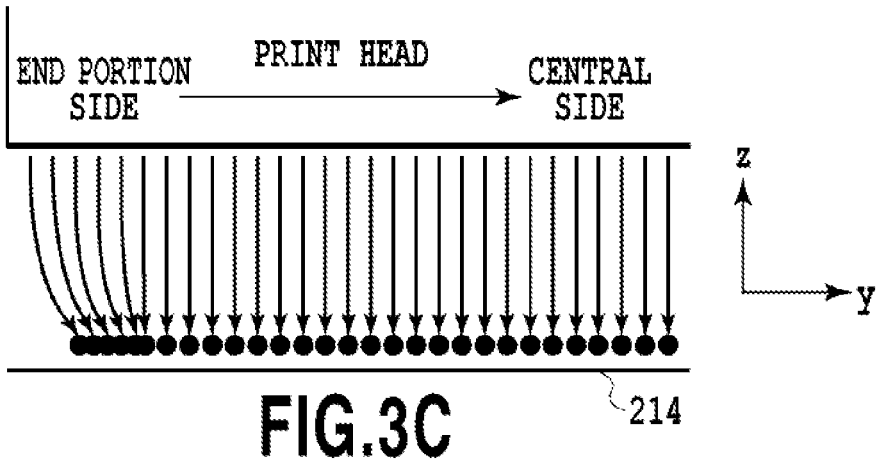
FIG. 3C is a diagram showing a relation between an ejection amount and a print position of ink.

FIG. 3A to FIG. 3C are diagrams each showing a relation between ink amounts ejected from nozzles of the print head and print positions of inks ejected from the nozzles of the print head. FIG. 3A is a diagram showing the movement of ink ejected from the nozzle in a case of a low duty in which the ejection amount of ink is relatively small, and FIG. 3B is a diagram showing the movement of ink ejected from the nozzle in a case where the ejection amount of ink is an intermediate duty. FIG. 3C is a diagram showing the movement of ink ejected from the nozzle in a case of a high duty in which the ejection amount of ink is relatively large.

As shown in FIG. 3A, in a case where the ejection amount is the low duty, the ink ejected from the nozzle is applied to a substantially vertical position to the print medium 214 from the ejection position. However, as the ejection amount increases, as shown in FIG. 3B and FIG. 3C the ink ejected from the nozzle which is in an end portion side (end portion area) of the print head is applied to a position closer to a central part of the print head toward the print medium 214. This is caused by a change in air flow in a space between a face (nozzle face) of the print head having the nozzles and the print medium 214 due to an air stream (self-air stream) generated at an ejecting time of ink ejected from the nozzle in the print head.

As a result, in a case where the ejection amount of ink is large (high duty), the ink ejected from the nozzle in the end portion area of the print head is printed in a position closer to the central part than the substantially vertical position from the ejection position of the nozzle toward the print medium 214. Therefore a band where the ejection amount of ink is relatively larger (high duty) has a tendency that the print width (print width in the conveying direction of the print medium 214) is narrower than a band where the ejection amount of ink is relatively small (low duty).

The self-air stream changes subjected to an influence of an inflow air stream generated due to the scanning movement of the print head. As a result, the print width printed on the print medium 214 also changes by the influence of both the self-air stream and the inflow air stream. In some cases the inflow air stream is subjected to an influence of a shape of the print head or a moving speed of the carriage at scanning by the print head.

Figure 4A:
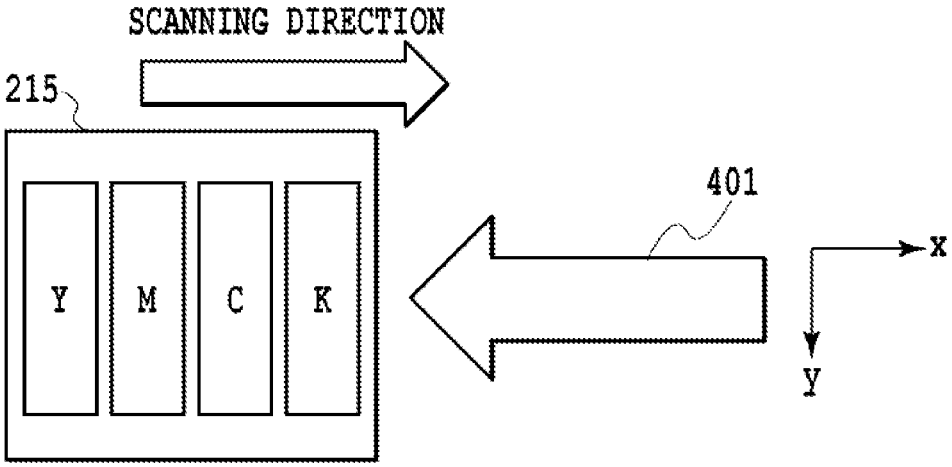
FIG. 4A is a diagram showing a relation between a scanning direction of a print unit and an inflow air stream.
Figure 4B:
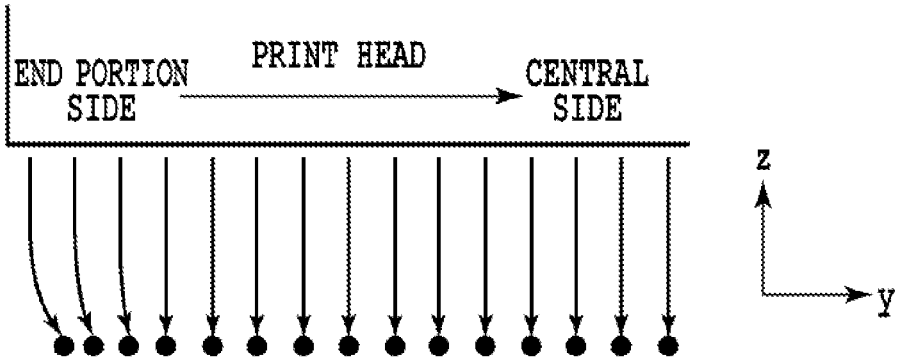
FIG. 4B is a diagram showing a print position of ink in a case where an inflow air stream is relatively weak.
Figure 4C:
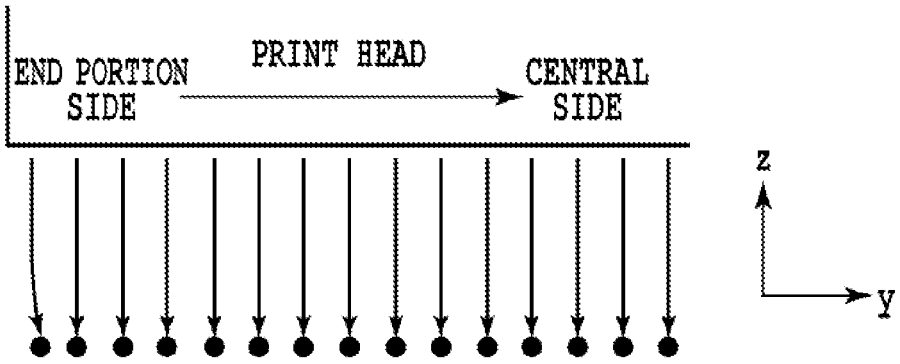
FIG. 4C is a diagram showing a print position of ink in a case where an inflow air stream is relatively strong.

A relation between the self-air stream and the inflow air stream will be explained. FIG. 4A to FIG. 4C are diagrams showing an inflow air stream and a change in the print position of ink. FIG. 4A shows a relation between a scanning direction of the printing unit 215 and the inflow air stream, FIG. 4B shows print positions of ink in a case where the inflow air stream is relatively small, and FIG. 4C shows print positions of ink in a case where the inflow air stream is relatively strong.

As shown in FIG. 4A, when the print head moves in a scanning direction, the inflow air stream 401 enters into the nozzle face of the print head. FIG. 4B and FIG. 4C each show a state where the inflow air stream enters into the nozzle face of the print head shown in FIG. 3B. By referring again to FIG. 3B, also in a case where the ejection amount of ink is the degree of an intermediate amount, the ink ejected from the nozzle arranged in the end portion area of the print head is printed in a position closer to a central part of the print head onto the print medium 214 than a substantially vertical position thereto, by an influence of the self-air stream.

In a case where a relatively weak inflow air stream enters into the nozzle face of the print head in a state shown in FIG. 3B, the print position of ink ejected from the nozzle in the end portion area of the print head, as shown in FIG. 4B, is not almost different from that in a case shown in FIG. 3B where the inflow air stream does not enter into the nozzle face. On the other hand, in a case where a relatively strong inflow air stream enters into the nozzle face, the ink concentration on the central part is, as shown in FIG. 4C, eliminated by the influence of the inflow air stream, the print position of ink ejected from the nozzle in the end portion area of the print head comes to a position substantially vertical from the ejection position.

In this way, since the print position of ink ejected from the nozzle of the print head changes by the influence of not only the self-air stream but also the inflow air stream, the print width also changes by the influence of the self-air stream and the inflow air stream.

Further, the influence of the inflow air stream differs depending on the shape of the print head, but in some cases depending on the position of each nozzle array in the scanning direction. Ink ejected from nozzles forming the nozzle array positioned at the forward side in the scanning direction is more susceptible to the influence of the inflow air stream than ink ejected from nozzles forming the nozzle array positioned at the backward side in the scanning direction. Therefore in a case where the nozzle arrays of the respective colors are arranged to be vertical respectively to the scanning direction and to be in parallel with each other, in some cases the print width differs for each color. A relation that the print width differs for each scanning direction will be explained with reference to FIG. 5A and FIG. 5B.

Figure 5A:
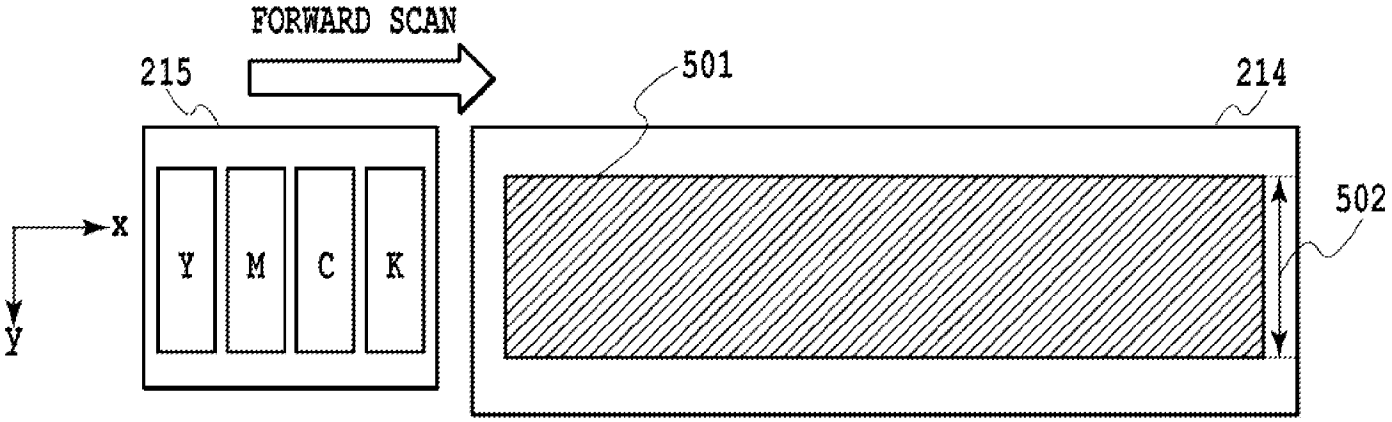
FIG. 5A is a diagram showing a relation between a scanning direction and a print width.
Figure 5B:
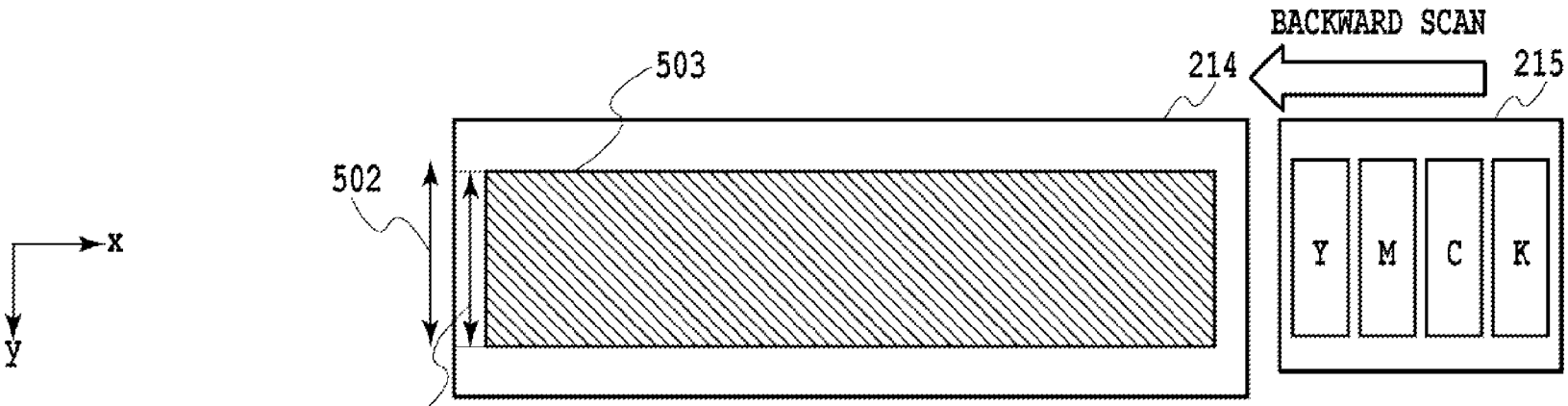
FIG. 5B is a diagram showing a relation between a scanning direction and a print width.

FIG. 5A and FIG. 5B are diagrams each showing a relation between a scanning direction and a print width, and showing a print width to be printed by black ink. FIG. 5A shows a print width to be printed at the time the print head scans (forward scan) in a direction where the nozzle array for ejecting black ink is positioned forward in the scanning direction. FIG. 5B shows a print width to be printed at the time the print head scans (backward scan) in a direction where the nozzle array for ejecting black ink is positioned backward in the scanning direction.

As described above, ink ejected from nozzles forming the nozzle array positioned at the forward side in the scanning direction is susceptible to the influence of the inflow air stream. Ink ejected from the nozzle in the end portion area of the nozzle array among the nozzles forming the nozzle array positioned at the forward side in the scanning direction is subjected to the influence of the inflow air stream to alleviate concentration to the central part by the self-air stream, so that the print width becomes relatively wide. On the other hand, in regard to ink ejected from the nozzle in the end portion area of the nozzle array among the nozzles forming the nozzle array positioned at the backward side in the scanning direction, since the ink concentration to the central part by the self-air stream is not sufficiently alleviated, the print width becomes relatively narrow.

Therefore a print width 502 of an image 501 at the forward scanning time shown in FIG. 5A is wider than a print width 504 of an image 503 at the backward scanning time shown in FIG. 5B.

Figure 6:
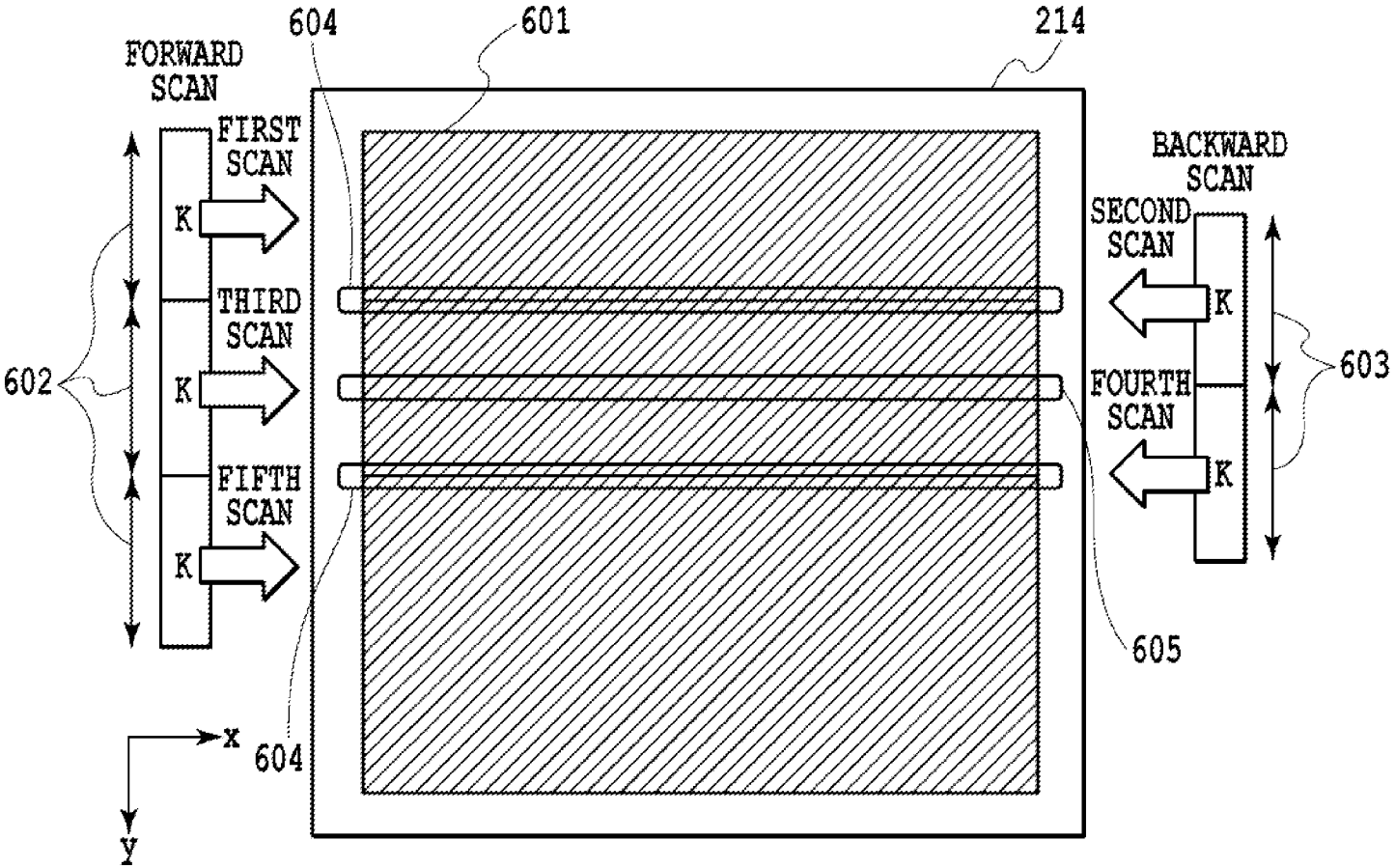
FIG. 6 is a diagram showing a relation between a scanning direction and a connecting streak.

FIG. 6 is a diagram showing a relation between a scanning direction and a connecting streak, and shows connecting streaks in a case of performing a two-pass print. An image 601 shown in the same figure shows an image printed by black ink. In the present embodiment, in the two-pass print of completing the print with twice of scans by a combination of the forward and backward scans, the print medium 214 is conveyed by about a half-length of a printable width for each one time of the scan. The first scan, the third scan and the fifth scan are the forward scans, and the second scan and the fourth scan are the backward scans.

In FIG. 6, a connecting part 604 shows a connecting part formed during the forward scan, and a connecting part 605 shows a connecting part formed during the backward scan. A print width 602 shows a print width in an area printed in the forward scan, and a print width 603 shows a print width in a an area printed in the backward scan.

As described above, since the print width in the forward scan differs from that in the backward scan, the connecting parts formed during the respective scans are visually different. That is, the connecting part formed in the forward scan having the wide print width becomes a streak having dark color tone. On the other hand, the connecting part formed in the backward scan having the narrow print width becomes a streak which is difficult to be visually distinct. For reducing an ink amount to be ejected, print data are thinned out, thereby making it possible to cause the connecting part generated in the forward scan to be difficult to be visually distinct, but when the print data are equally thinned out from all the connecting parts, there are some cases where a streak having light color tone is generated in the connecting part formed in the backward scan.

Therefore in the present embodiment, the correction processing to be executed to the connecting part is differentiated for each scanning direction. In more detail, the thinning-out of print data corresponding to a nozzle for ejecting ink to the connecting part is performed corresponding to an ejection amount (duty) for each color of ink, and a thinning-out rate of the thinning-out corresponding to the duty is switched for each scan direction forming the connecting part. For switching the thinning-out rate corresponding to an ink amount scheduled to be ejected, a dot count of print data is performed. That is, the number of times by which ink is scheduled to be ejected (scheduled number of times of ink ejection) is counted.

Figure 7:
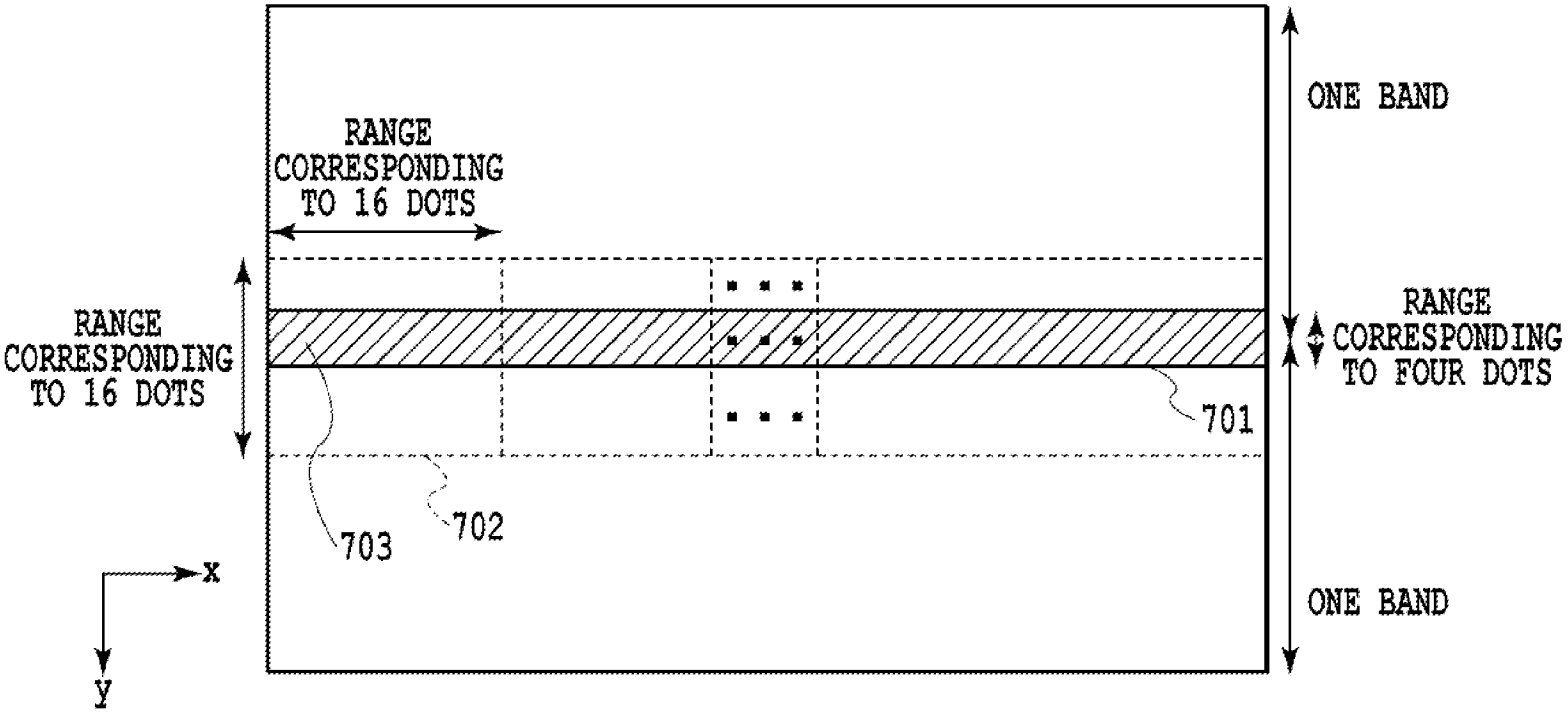
FIG. 7 is a diagram showing a connecting section, a dot count area, and a thinning-out area.

FIG. 7 is a diagram showing a connecting section (connecting part 701), a dot count area 702, and a thinning-out area 703. The connecting part 701 is a boundary between areas to be printed by the respective scans of the print head.

As shown in FIG. 7, the connecting part 701 in the present embodiment is an area in accordance with four dots in the conveying direction in the boundary between bands. The dot count area 702 is a predetermined area including a part of the boundary. The dot count area in the present embodiment is an area in accordance with 16 dots in the scanning direction and 16 dots in the conveying direction across the connecting part 701. The thinning-out area 703 in the present embodiment is an area in accordance with 16 dots in the scanning direction and four dots in the conveying direction across the connecting part 701 for each area on which the dot count is performed.

It should be noted that a range of each area of the connecting part 701, the dot count area 702, the thinning-out area 703 is all shown simply as an example, and each area is not limited to the above range.

Figures 8A, 8B, 8C, 8D, 8E:
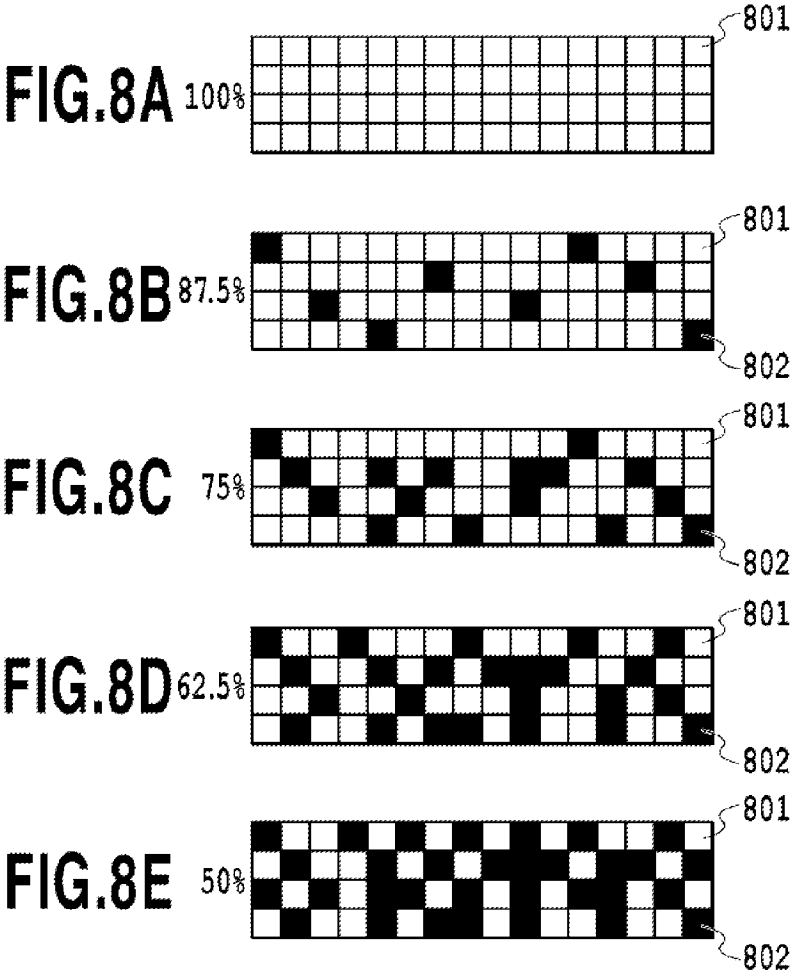
FIG. 8A is a diagram showing a thinning-out mask.
FIG. 8B is a diagram showing a thinning-out mask.
FIG. 8C is a diagram showing a thinning-out mask.
FIG. 8D is a diagram showing a thinning-out mask.
FIG. 8E is a diagram showing a thinning-out mask.
Figures 8F, 8G, 8H, 8I:
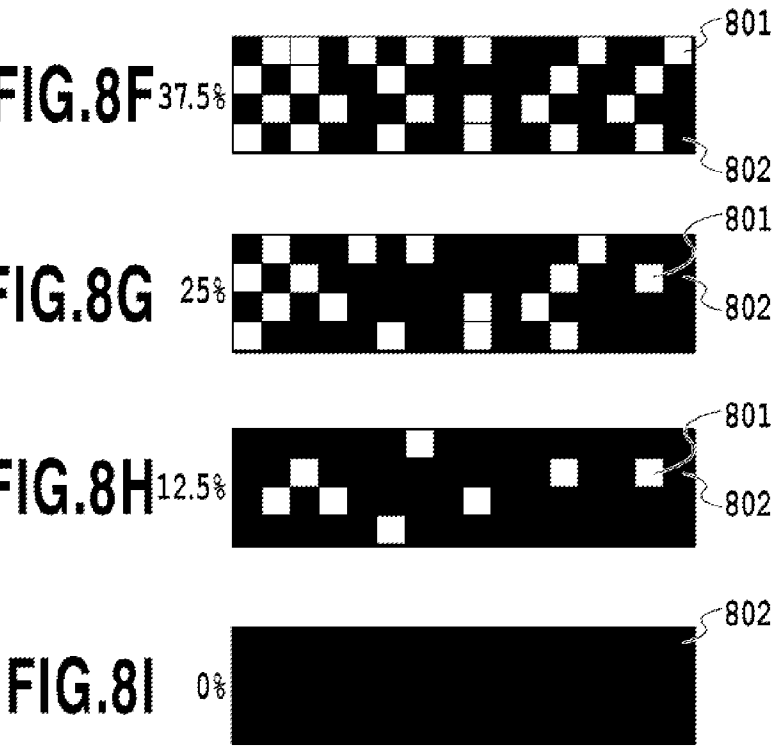
FIG. 8F is a diagram showing a thinning-out mask.
FIG. 8G is a diagram showing a thinning-out mask.
FIG. 8H is a diagram showing a thinning-out mask.
FIG. 8I is a diagram showing a thinning-out mask.

The thinning-out processing is executed using a thinning-out mask pattern in advance set. FIG. 8A to FIG. 8I are diagrams each showing a thinning-out mask used in the present embodiment. As shown in FIG. 8A to FIG. 8I, the thinning-out mask used in the present embodiment is classified as nine types to correspond to the respective thinning-out rates of print data. FIG. 8A shows a mask of 100%, FIG. 8B shows a mask of 87.5%, FIG. 8C shows a mask of 75%, FIG. 8D shows a mask of 62.5%, FIG. 8E shows a mask of 50%, FIG. 8F shows a mask of 37.5%, FIG. 8G shows a mask of 25%, FIG. 8H shows a mask of 12.5% and FIG. 8I shows a mask of 0% in regard to the respective thinning-out rates.

One cell shown in FIG. 8A to FIG. 8I indicates one pixel, and a filled cell is an ON dot 802 which is a print permitting pixel to which ink is applied, and a not-filled cell is an OFF dot 801 which is a non-print permitting pixel to which ink is not applied. Ink is applied only in a case where the cell becomes an ON dot by logical product of print data and a thinning-out mask, and thereby the print data corresponding to the nozzle for ejecting ink to the connecting part are thinned out.

Figure 9A:
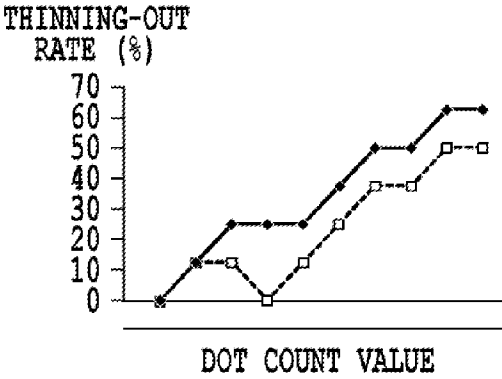
FIG. 9A is a graph showing a relation between a dot count value and a thinning-out rate of black ink.
Figure 9B:
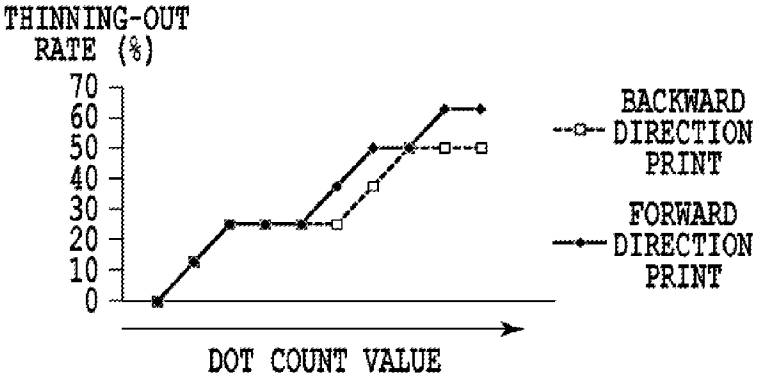
FIG. 9B is a graph showing a relation between a dot count value and a thinning-out rate of cyan ink.
Figure 9C:
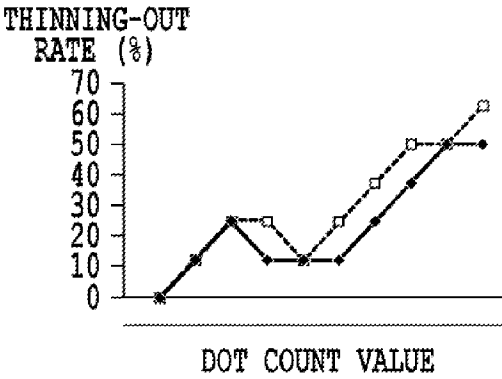
FIG. 9C is a graph showing a relation between a dot count value and a thinning-out rate of magenta ink.
Figure 9D:
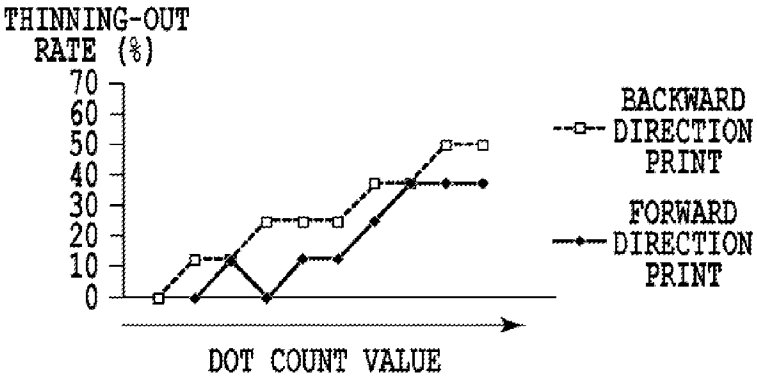
FIG. 9D is a graph showing a relation between a dot count value and a thinning-out rate of yellow ink.

FIG. 9A to FIG. 9D are graphs each showing a relation between a dot count value and a thinning-out rate for each color of ink (sum of the scheduled ejection numbers of ink) in the present embodiment. A horizontal axis in each of FIG. 9A to FIG. 9D indicates a dot count value, and a vertical axis thereof indicates a thinning-out rate. FIG. 9A shows a relation between a dot count value and a thinning-out rate for black ink, FIG. 9B shows a relation between a dot count value and a thinning-out rate for cyan ink, FIG. 9C shows a relation between a dot count value and a thinning-out rate for magenta ink, and FIG. 9D shows a relation between a dot count value and a thinning-out rate for yellow ink. It should be noted that a scale of the dot count value (horizontal axis) in each of FIG. 9A to FIG. 9D is the same with each other.

As shown in FIG. 9A to FIG. 9D, in any color, the thinning-out rate to the dot count value basically increases. This is because it is desirable to increase the thinning-out rate since there is a tendency that overflow or ooze of ink is easily generated as an ink ejection amount (duty) increases, to produce a streak having dark color tone. In addition, as seen from FIG. 9A and FIG. 9D, particularly in a high duty, the thinning-out rate of black ink at the forward direction scanning time is set to be higher than the thinning-out rate of yellow ink at the backward direction scanning time in the same duty. This is because, since the yellow ink is higher in brightness than the black ink, even if a black streak is formed, it is difficult to be visible, and therefore it is possible to restrict image quality degradation due to the black streak even if the thinning-out rate is made low. It should be noted that in a range where a white streak is not generated, the thinning-out rate of yellow ink at the backward direction scanning time may be the same as the thinning-out rate of black ink at the forward direction scanning time.

In each nozzle array, the thinning-out rate is set to be the higher corresponding to the extent that a scan of the nozzle array which is positioned at the more forward side is more largely subject to an influence of the inflow air stream than a scan of the nozzle array which is positioned at the more backward side. That is, an ejection amount of ink in a case where a nozzle array is positioned at the forward side in the scanning direction is reduced relative to an ejection amount of ink in a case where the nozzle array is positioned at the backward side in the scanning direction. Therefore in the present embodiment, the amount of ink is adjusted according to a predetermined reduction rate.

However, In any nozzle array, at a point where the dot count value reaches a predetermined dot count value, since a force in the opposing direction to the inflow air stream is added by the self-air stream, the thinning-out rate does not only increase simply.

In the present embodiment, the thinning-out rate, that is, the mask in use is thus appropriately switched corresponding to the ejection amount or the scanning direction in such a manner as to be able to correspond to the inflow air stream or the self-air stream which changes in accordance with the ejection amount (duty) and the scanning direction.

In the present embodiment, the table showing a corresponding relation between the dot count value for each color of ink and the thinning-out rate for each scanning direction, and the thinning-out mask as shown in each of FIG. 9A to FIG. 9D, are in advance stored in the ROM of the control unit 301.

In this way, in the present embodiment, the thinning-out rate, that is, the mask for each color of ink is determined corresponding to the ejection amount (dot count value) and the scanning direction to thin out the print data. This operation will be explained with reference to FIG. 10.

Figure 10:
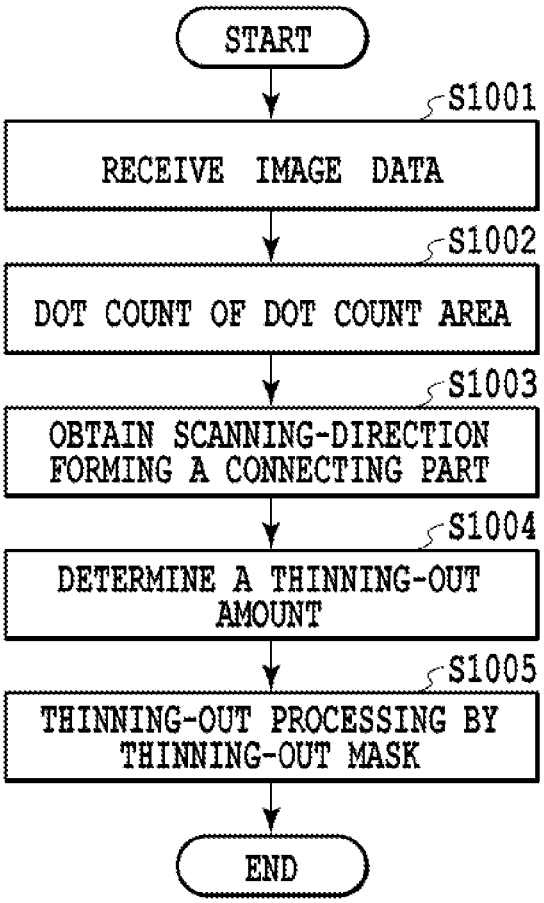
FIG. 10 is a flow chart showing an operation of thinning-out processing.

FIG. 10 is a flow chart showing an operation of the thinning-out processing. The control unit 301 receives image data through the interface 302 from the host PC 303 (S1001). The control unit 301 performs various processing to the image data. That is, the control unit 301 performs image processing of the image data received from the host PC 303, and generates printable print data by the print head. In more detail, the control unit 301 performs color conversion processing or binary processing to the input image data. In addition, resolution conversion, image analysis, image correction, and the like are performed as needed.

Next, a dot count is performed to binary data of an ink color for each dot count area (S1002). The control unit 301 obtains information in the scanning direction forming a connecting part which is an execution target of the thinning-out processing (S1003), and determines a thinning-out rate from the table of the dot count value and the thinning-out rate in the scanning direction for each color of ink as shown in FIG. 9A to FIG. 9D (S1004). By using the thinning-out mask shown in each of FIG. 8A to FIG. 8I corresponding to the determined thinning-out rate, the thinning-out processing is performed for each thinning-out area (S1005).

(Second Embodiment)

In the present embodiment, not only the print data are thinned out but also the print data (dots) are added. Since the other configuration is the same as that of the first embodiment, an explanation thereof is omitted. Addition of dots is performed using additional masks. The thinning-out mask is used to a logical product of the print data, but the additional mask is used to a logical addition to the print data.

FIG. 11A to FIG. 11I are diagrams showing thinning-out masks and additional masks used in the present embodiment. FIG. 11A to FIG. 11E show thinning-out masks, and FIG. 11F and FIG. 11I show additional masks. FIG. 11A shows a thinning-out mask of 50%, FIG. 11B shows a tinning-out mask of 37.5%, FIG. 11C shows a thinning-out mask of 25%, FIG. 11D shows a thinning-out mask of 12.5%, and FIG. 11E shows a thinning-out mask of 0% in regard to the respective thinning-out rates. FIG. 11F shows an additional mask of 12.5%, FIG. 11G shows an additional mask of 25%, FIG. 11H shows an additional mask of 37.5% and FIG. 11I shows an additional mask of 50% in regard to the respective additional rates.

In the present embodiment, an additional mask is used to the print data corresponding to a nozzle for ejecting ink to the connecting part in such a manner as to increase ink that is applied in an area where a streak having light color tone tends to be easily generated because of a narrow print width. Further, in the present embodiment, a thinning-out mask is used to the print data corresponding to a nozzle for ejecting ink to the connecting part in such a manner as to decrease ink that is applied in an area where a streak having dark color tone tends to be easily generated because of a wide print width.

Figure 12A:
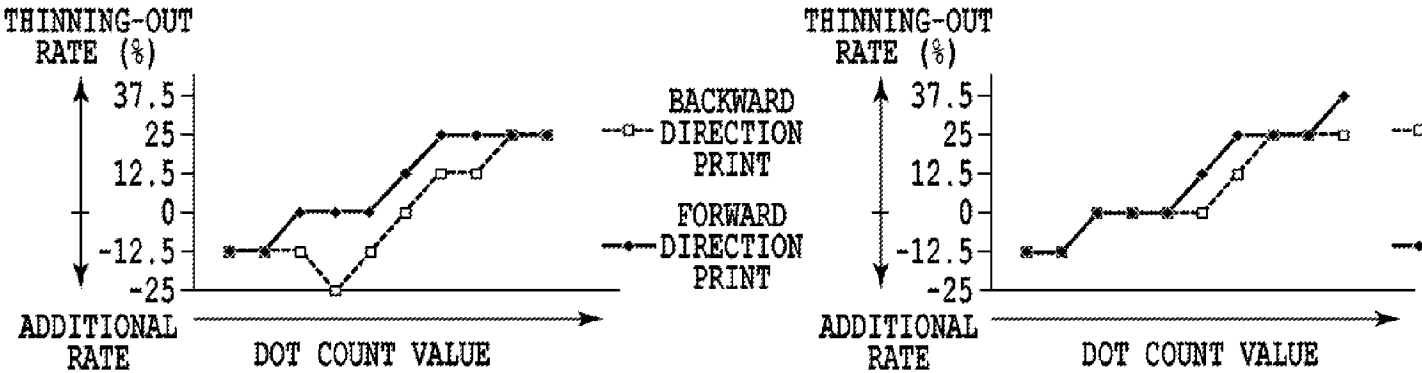
FIG. 12A is a graph showing a dot count value, a thinning-out rate and an additional rate of black ink.
Figure 12B:
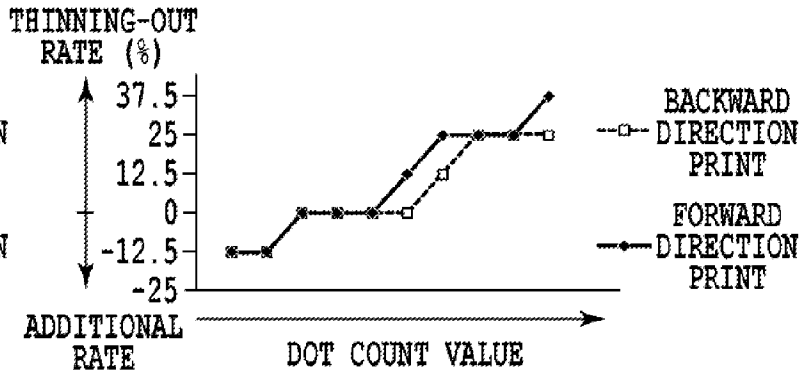
FIG. 12B is a graph showing a dot count value, a thinning-out rate and an additional rate of cyan ink.
Figure 12C:
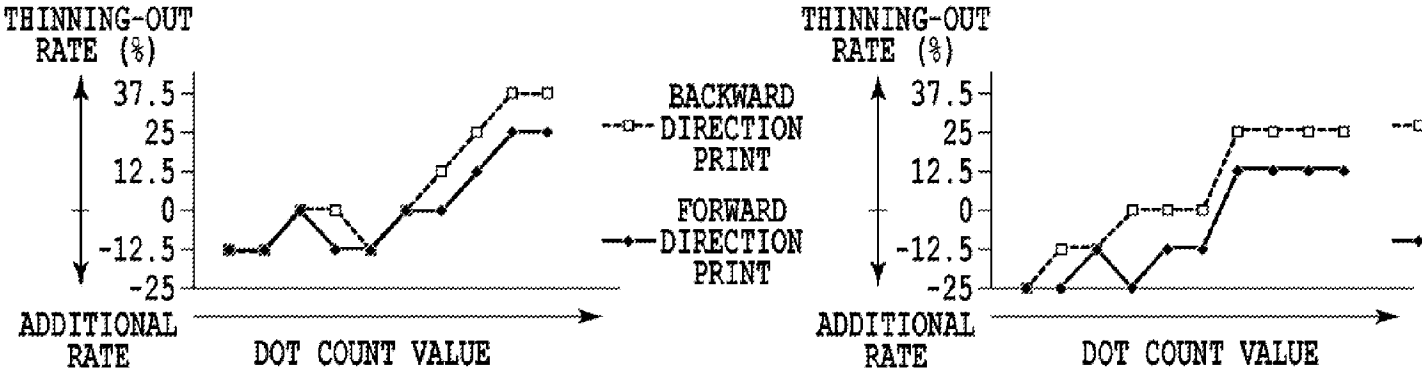
FIG. 12C is a graph showing a dot count value, a thinning-out rate and an additional rate of magenta ink.
Figure 12D:
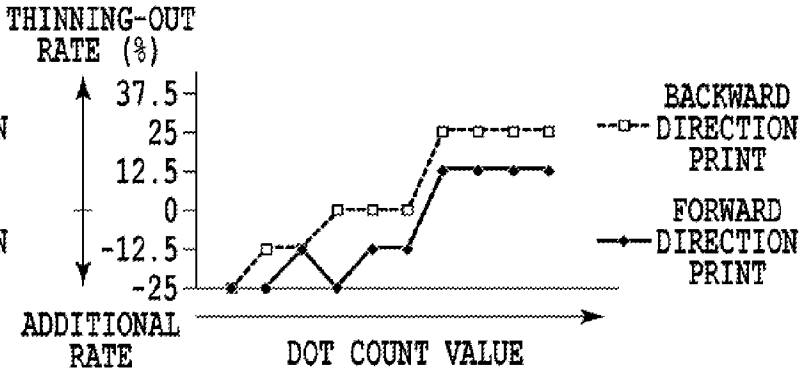
FIG. 12D is a graph showing a dot count value, a thinning-out rate and an additional rate of yellow ink.

FIG. 12A to FIG. 12D are graphs each showing a relation between a dot count value, a thinning-out rate and an additional rate for each color of ink in the present embodiment. A horizontal axis in each of FIG. 12A to FIG. 12D indicates a dot count value, and a vertical axis thereof indicates a thinning-out rate and an additional rate. FIG. 12A shows a relation between a dot count value, a thinning-out rate and an additional rate respectively for black ink, FIG. 12B shows a relation between a dot count value, a thinning-out rate and an additional rate respectively for cyan ink, FIG. 12C shows a relation between a dot count value, a thinning-out rate and an additional rate respectively for magenta ink, and FIG. 12D shows a relation between a dot count value, a thinning-out rate and an additional rate respectively for yellow ink.

As shown in FIG. 12A to 12D, in a case where the dot count value is relatively small in any ink, the additional mask is used in any of the forward and backward scans. In a case where the dot count value is relatively large in any ink, the thinning-out mask is used in any of the forward and backward scans.

As in the case of the first embodiment, in a case where only the thinning-out mask is used to thin out data, thus correcting a black stream, it is not possible to avoid a white streak generated in an area where the dot count value is small. Therefore it is desirable to set a conveying amount to the extent that the white streak does not appear in the conveying operation performed during the print scan.

However, according to this conveyance of the print medium 214, there are some cases where the printed print medium 214 is shorter than an original length of the print data. Therefore, for preventing generation of the streak in the connecting part while keeping an entire length of the print data, it is more desirable to use the thinning-out mask or the additional mask as needed for performing the thinning-out and the addition of the print data.

In this way, according to the present embodiment, it is possible to restrict generation of the connecting streak by using not only the thinning-out mask but also the additional mask.

(Third Embodiment)

In the present embodiment, the thinning-out rate is set in accordance with a difference in print rate for each scanning direction. Since the other configuration is the same as that of the first embodiment, an explanation thereof is omitted.

In a two-pass print of completing a print by twice of scans, the print medium is conveyed by a half-length of the print head for each time one time of the scan is completed.

On the other hand, for preventing a difference in color (color order difference unevenness) due to the event that the order of printing ink differs between the forward scan and the backward scan, there is known a method of changing a conveying amount of the print medium and a conveying direction of the print medium for each scan. As is explained in more detail with reference to FIG. 13A and FIG. 13B, after a first scan is performed to the forward direction, the print medium is conveyed by a half-length of the print head in a direction in reverse to a Y direction to perform a second scan in the backward direction. After that, the print medium is conveyed by a length corresponding to one and a half of the print heads in the Y direction to perform a third scan in the forward direction. Hereinafter, such scan and conveyance are alternately performed to print an image on the print medium.

According to this method, the print order of ink to the print medium is uniformed, but a difference in time from the first scan to the second scan exists for each area. When the time from the first scan to the second scan differs for each area, a difference in color (time difference unevenness) is possibly generated. However, this time difference unevenness can be alleviated by changing a print rate (rate for actually printing dots in each scan among the print data) for each scan.

That is, an amount of ink to be printed in the first scan is made relatively large to cause the ink to sufficiently permeate the print medium. As a result, even if the time until the second scan for printing the remaining print data differs, the influence can be controlled to be low to prevent the time difference variation.

When the print rate changes for each scan in this way, a visibility of the connecting streak generated in the connecting part between bands differs for each scan.

Figure 13B:
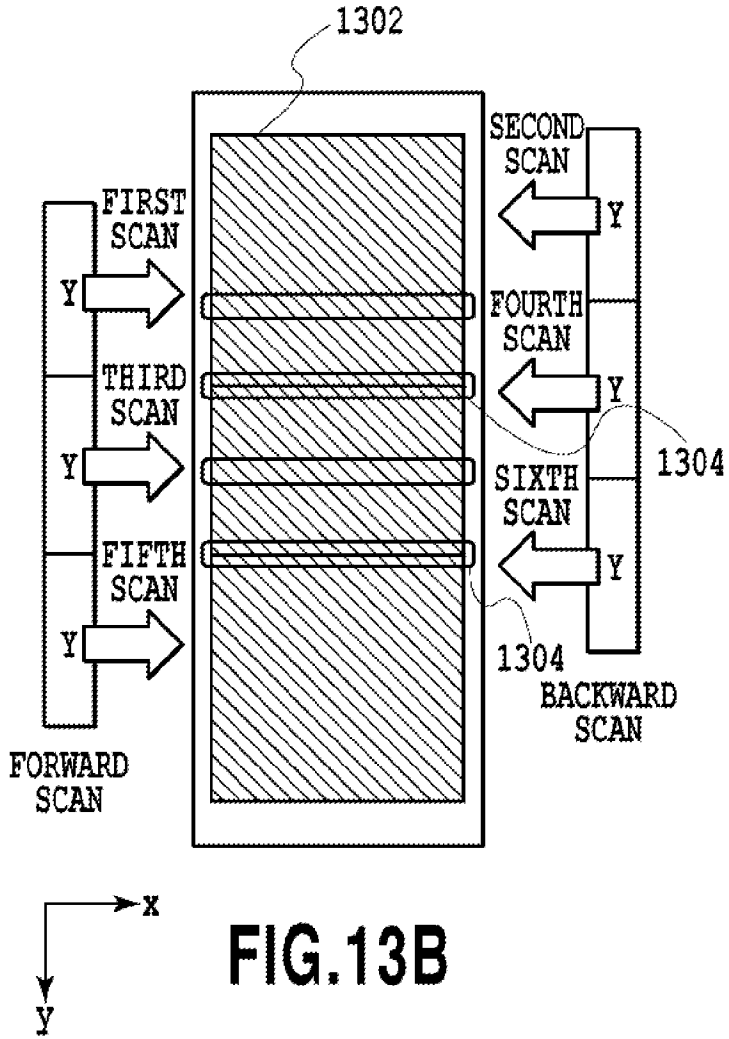
FIG. 13B is a diagram explaining a connecting streak.
Figure 13A:
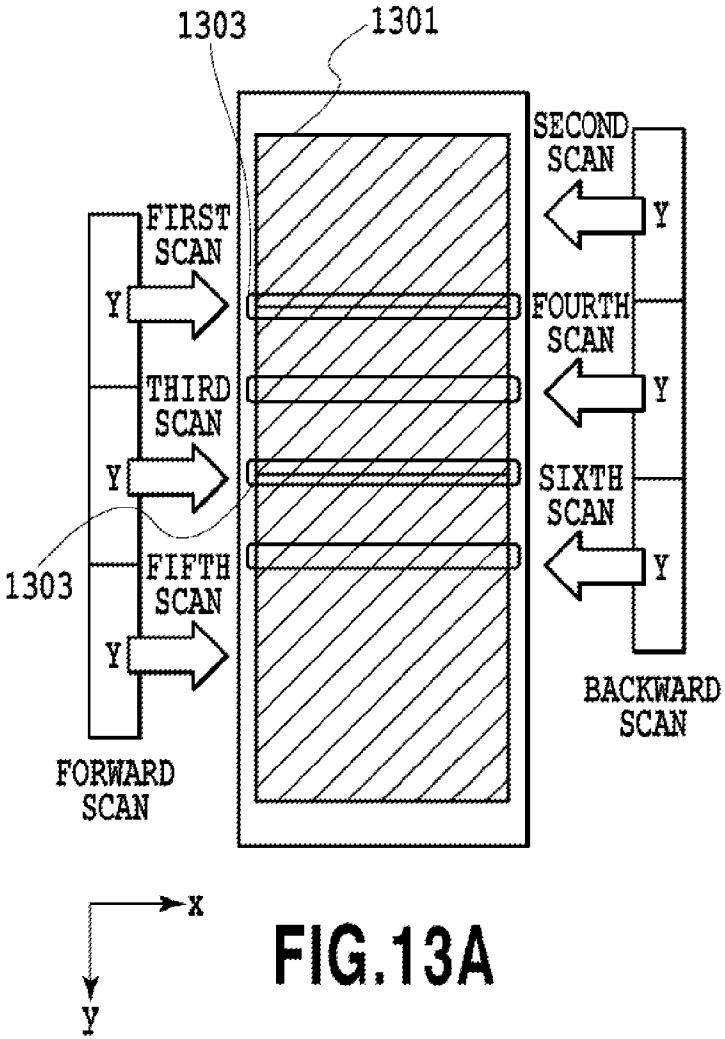
FIG. 13A is a diagram explaining a connecting streak.

FIG. 13A and FIG. 13B are diagrams each explaining a connecting streak generated in a case where the print rate differs for each scanning direction. In FIG. 13A and FIG. 13B, a case of printing by yellow ink will be explained. In addition, in FIG. 13A and FIG. 13B, the print rate in the forward scan is set to 70% of the whole, and the print rate in the backward scan is set to 30% of the whole.

FIG. 13A shows a connecting streak in a case where a print duty of a printed image is 35%, and FIG. 13B shows a connecting streak in a case where a print duty of a printed image is 75%. As shown in FIG. 13A, in a case where the print duty is 35% and the ejection amount of ink is relatively small, a connecting streak 1303 is generated only between the backward scans each having a smaller print rate than a print rate of the forward scan. On the other hand, as shown in FIG. 13B, in a case where the print duty is 75% and the ejection amount of ink is relatively large, a connecting streak 1304 is generated only between the forward scans each having a larger print rate than a print rate of the backward scan.

Such a difference in generation of the streak is made because the print rate differs and the influence of the self-air stream differs for each of the forward and backward scans. In the present embodiment, for preventing such a connecting stream, the thinning-out rate of the print data is made to differ depending on a difference of the print rate for each scanning direction.

Figure 14A:
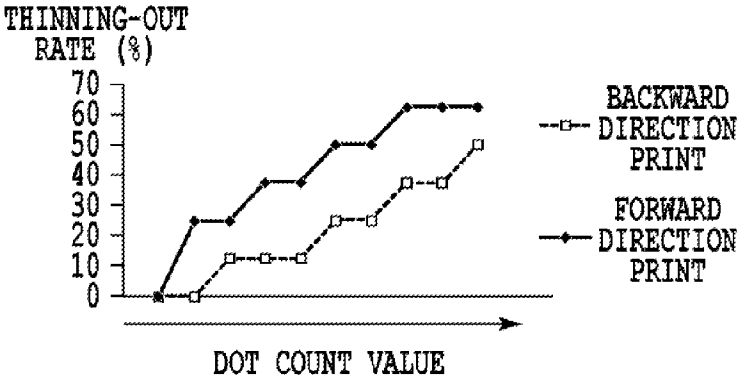
FIG. 14A is a graph showing a dot count value and a thinning-out rate.
Figure 14B:
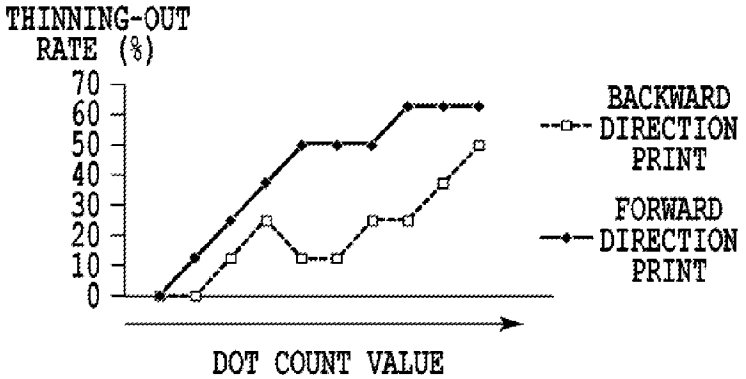
FIG. 14B is a graph showing a dot count value and a thinning-out rate.
Figure 14C:
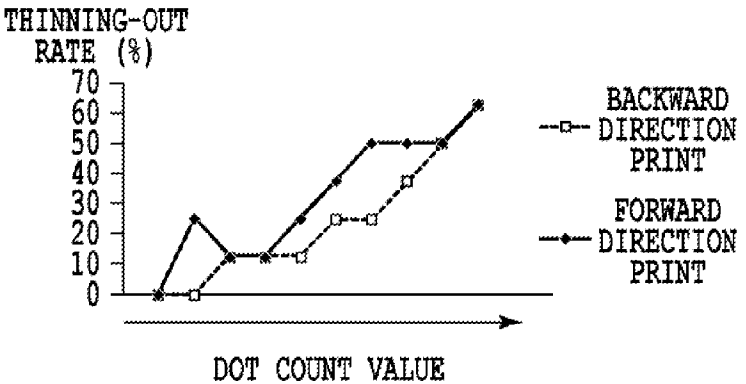
FIG. 14C is a graph showing a dot count value and a thinning-out rate.
Figure 14D:
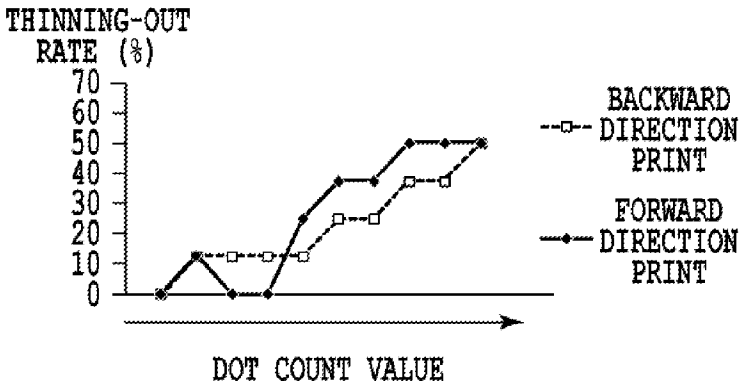
FIG. 14D is a graph showing a dot count value and a thinning-out rate.

FIG. 14A to FIG. 14D are graphs each showing a relation between a dot count value and a thinning-out rate in the present embodiment. A horizontal axis in each of FIG. 14A to FIG. 14D indicates a dot count value, and a vertical axis thereof indicates a thinning-out rate. FIG. 14A shows a relation between a dot count value and a thinning-out rate for black ink, FIG. 14B shows a relation between a dot count value and a thinning-out rate for cyan ink, FIG. 14C shows a relation between a dot count value and a thinning-out rate for magenta ink, and FIG. 14D shows a relation between a dot count value and a thinning-out rate for yellow ink.

As shown in FIG. 14A and FIG. 14B, the thinning-out rate of each of black ink and cyan ink ejected from a nozzle which is positioned at the forward side in the scanning direction in the forward scan is larger in the forward scan than in the backward scan. As shown in FIG. 14C and FIG. 14D, a comparison relation in the thinning-out rate in the forward and backward scans of each of magenta ink and yellow ink ejected from a nozzle which is positioned at the forward side in the scanning direction in the backward scan differs from that of the first embodiment and the second embodiment.

As explained above, even in a case where the print rate between the forward scan and the backward scan differs for restricting the time difference variation and the like, when an appropriate thinning-out rate is selected corresponding to the scanning direction, and the print rate, the dot count value and the ink color in each scanning direction, the present embodiment can obtain the effect similar to that of the above embodiment.

(Other Embodiments)

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may include one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

It should be noted that the configuration and the number of the above nozzle array or print head, further, the kind of the ink color or the number of the kind of the ink colors are illustrated simply as examples, and may be altered as needed. For example, four colors of K, C, M and Y are illustrated as the ink colors in the above embodiment, but light cyan and light magenta low in density, or a spot color such as red or green may be used.

In addition, in regard to the thinning-out of the connecting part, by taking an image of a single color as an example, the method of determining the thinning-out rate of each ink by dot count for each color is explained. However, in regard to the thinning-out of the connecting part, there may be adopted a method that the hue of the image is determined from the result of the dot count to the image configured by a plurality of colors, and the thinning-out rate of each ink color is determined from the hue and the total dot number. Thereby the thinning-out rate can be in more finely determined, such as by increasing the thinning-out rate in the hue where the streak tends to be easily visually distinct or in the hue such as the secondary color where the dot number tends to be easily large.

In the above embodiment, an explanation is made of the method where, as the method of reducing the ejection amount of ink, the thinning-out mask is in advance set for each thinning-out rate and that mask is applied to the nozzle for ejecting ink to the connecting part, but the method of the thinning-out is not limited thereto. For example, there may be adopted a method of determining whether or not the print data are thinned out to each of the print data after binarization.

In the above embodiment, an explanation is made of the method of thinning out the print data corresponding to the nozzle for printing on the connecting part. However, as long as the method in which the print data corresponding to a predetermined number of nozzles in at least one of the end portion areas of the nozzle array in the arrangement direction of nozzles forming the nozzle array are thinned out is adopted, the effect of the present invention can be sufficiently obtained. Further, the effect of the present invention can be obtained by thinning out the print data corresponding to the nozzle positioned in the end portion area in the nozzle array, and also to the nozzle which ejects ink in the same area on the print medium and is positioned other than the end portion area.

A predetermined nozzle array in which nozzles (first nozzle, second nozzle, and third nozzle) an ejection amount of which is adjusted is arranged in a position where the number of the other nozzle array arranged closer to one of the scanning direction side from this is smaller than the number of the other nozzle array arranged closer to the other of the scanning direction side from this.

In the third embodiment, an explanation is made of the measure in the two-pass print, but the present invention can be adapted also to the pass number other than the two-pass. An example of the graph of the thinning-out rate is shown in each of FIG. 9, FIG. 12 and FIG. 14, but in some cases an appropriate thinning-out rate differs depending on a kind of the print medium (for example, a difference in material). Therefore a plurality of tables of the thinning-out rate optimized for each kind of the print medium are stored, and an appropriate table may be selected corresponding to the print medium for performing a print, or corresponding to a change in an interval between the print head and the print medium.

In regard to the thinning-out rate and the additional rate corresponding to the scanning direction, the thinning-out or the addition is performed only to the connecting part formed between a scans in one direction of the forward scan or the backward direction, and the thinning-out or the addition is not performed to the connecting part formed between a scans in the other direction. In this manner, the processing between the scans may differ depending on the scanning direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-020586, filed Feb. 5, 2013, which is hereby incorporated by reference herein in its entirety.

What is claimed is:

1. An inkjet printing apparatus for printing an image by ejecting ink comprising:

a print head in which a plurality of nozzle arrays, in each of which a plurality of nozzles for ejecting ink are arranged in a predetermined direction, are arranged in a direction crossing the predetermined direction;

a scanning unit configured to perform scanning of the print head in a first direction crossing the predetermined direction and in a second direction which is opposite to the first direction, while causing the print head to eject ink;

an adjusting unit configured to adjust an amount of ink ejection from a first nozzle unit which includes a predetermined number of nozzles arranged in one of end positions in the predetermined direction of a first nozzle array, wherein the number of nozzle arrays arranged at a side of the first direction from the first nozzle array in the plurality of nozzle arrays is less than the number of nozzle arrays arranged at a side of the second direction from the first nozzle array in the plurality of nozzle arrays; and a control unit configured to control the print head so as to eject ink from the first nozzle unit according to the amount of the ink ejection adjusted by the adjusting unit, wherein the adjusting unit adjusts the amount of the ink ejection from the first nozzle unit such that amount of ink ejection from the first nozzle unit in a case that the scanning unit performs scanning of the print head in the first direction is smaller than amount of ink ejection from the first nozzle unit in a case that the scanning unit performs scanning of the print head in the second direction.

2. An inkjet printing apparatus according to claim 1, wherein the adjusting unit reduces the amount of ink ejection from the first nozzle unit according to a predetermined reduction rate.

3. An inkjet printing apparatus according to claim 2, wherein the adjusting unit increases the reduction rate as a scheduled amount of ink ejection from the first nozzle unit increases.

4. An inkjet printing apparatus according to claim 1, wherein the control unit, in a case where a scheduled amount of ink ejection from the first nozzle unit is larger than a predetermined amount, thins out the print data corresponding to the first nozzle unit.

5. An inkjet printing apparatus according to claim 1, wherein the control unit, in a case where a scheduled amount of ink ejection from the first nozzle unit is smaller than a predetermined amount, adds print data corresponding to the first nozzle unit.

6. An inkjet printing apparatus according to claim 1, wherein the control unit applies a mask pattern defining a print permitting pixel and a non-print permitting pixel to print data corresponding to the first nozzle unit.

7. An inkjet printing apparatus according to claim 1, wherein the adjusting unit causes a rate between a scheduled amount of ink ejection from the first nozzle array in the scan of the first direction and a scheduled amount of ink ejection from the first nozzle array in the scan of the second direction to differ and adjusts the amount of ink ejection from the first nozzle unit corresponding to the rate.

8. An inkjet printing apparatus according to claim 1, wherein the adjusting unit adjusts the amount of ink ejection from the first nozzle unit corresponding to an interval between the print head and a print medium.

9. An inkjet printing apparatus according to claim 1, wherein the first nozzle array includes a second nozzle unit including a predetermined number of the nozzles which are arrayed in an area other than the end portion area in the predetermined direction, and ejects ink in a same area on a print medium in which ink is ejecting from the first nozzle unit, and the adjusting unit adjusts the amount of ink ejection from the second nozzle unit such that the amount of ink ejection from the second nozzle unit in the scan of the first direction is reduced relative to the amount of ink ejection from the second nozzle unit in the scan of the second direction.

10. An inkjet printing apparatus according to claim 1, wherein the first nozzle array includes a second nozzle unit including a predetermined number of the nozzles arrayed in the other end portion area in the predetermined direction, further comprising:

a conveying unit configured to convey a print medium relative to the print head in a conveying direction crossing the first direction such that the first nozzle unit in the predetermined scan and the second nozzle unit in a scan different from the predetermined scan eject ink in areas adjacent on the print medium in the predetermined direction.

11. An inkjet printing apparatus according to claim 10, wherein the adjusting unit adjusts the amount of ink ejection from the second nozzle unit such that the amount of ink ejection from the second nozzle unit in the scan of the first direction is reduced relative to the amount of ink ejection from the second nozzle unit in the scan of the second direction.

12. An inkjet printing apparatus according to claim 1, wherein the plurality of the nozzle arrays further include a second nozzle array arranged closer to the second direction side than the first nozzle array, the second nozzle array includes a second nozzle unit including a predetermined number of the nozzles arrayed in the other end portion area in the predetermined direction, and the adjusting unit adjusts the amount of ink ejection from the first nozzle unit and the second nozzle unit such that the amount of ink ejection from the second nozzle unit is reduced to be less than the amount of ink ejection from the first nozzle unit of the first nozzle array in the scan of the first direction.

13. An inkjet printing apparatus for printing an image by ejecting ink comprising:

a print head in which a plurality of nozzle arrays, in each of which a plurality of nozzles for ejecting ink are arranged in a predetermined direction, are arranged in a direction crossing the predetermined direction;

a scanning unit configured to perform scanning of the print head in a first direction crossing the predetermined direction and in a second direction which is opposite to the first direction, while causing the print head to eject ink;

an adjusting unit configured to adjust an amount of the ink ejection from a first nozzle unit which includes a predetermined number of nozzles arranged in one of end positions in the predetermined direction of a first nozzle array, wherein the first nozzle array is arranged in a position where an air stream flowing between the print head and a print medium at a time of causing the print head to scan in the first direction is stronger than an air stream flowing between the print head and the print medium at a time of causing the print head to scan in the second direction; and a control unit configured to control the print head so as to eject ink from the first nozzle unit according to the amount of the ink ejection adjusted by the adjusting unit, wherein the adjusting unit adjusts the amount of ink ejection from the first nozzle unit such that amount of ink ejection from the first nozzle unit in a case that the scanning unit performs scanning by the print head in the first direction is smaller than amount of ink ejection from the first nozzle unit in a case that the scanning unit performs scanning by the print head in the second direction.

14. An inkjet printing method for printing an image by ejecting ink comprising:

a scanning step for causing a print head, in which a plurality of nozzle arrays, in each of which a plurality of nozzles for ejecting ink are arranged in a predetermined direction, are arranged in a direction crossing the predetermined direction, to scan in a first direction crossing the predetermined direction and in a second direction which is opposite to the first direction while causing the print head to eject ink;

an adjusting step for adjusting an amount of the ink ejection from a first nozzle unit which includes a predetermined number of nozzles arranged in one of end positions in the predetermined direction of a first nozzle array, wherein the number of nozzle arrays arranged at a side of the first direction from the first nozzle array in the plurality of nozzle arrays is less than the number of nozzle arrays arranged at a side of the second direction from the first nozzle array in the plurality of nozzle arrays; and a control step for controlling the print head so as to eject ink from the first nozzle unit according to the amount of the ink ejection adjusted in the adjusting step, wherein in the adjusting step, the amount of the ink ejection from the first nozzle unit is adjusted such that amount of ink ejection from the first nozzle unit in the scan of the first direction is smaller than amount of ink ejection from the first nozzle unit in the scan of the second direction.

15. An inkjet printing method according to claim 14, wherein in the adjusting step, the amount of ink ejection from the first nozzle unit is reduced according to a predetermined reduction rate.

16. An inkjet printing method according to claim 15, wherein in the adjusting step, the reduction rate is increased as a scheduled amount of ink ejection from the first nozzle unit increases.

17. An inkjet printing method according to claim 14, wherein in the control step, in a case where a scheduled amount of ink ejection from the first nozzle unit is larger than a predetermined amount, print data corresponding to the first nozzle unit are thinned out.

18. An inkjet printing method according to claim 14, wherein in the control step, in a case where a scheduled amount of ink ejection from the first nozzle unit is smaller than a predetermined amount, print data corresponding to the first nozzle unit are added.

19. An inkjet printing method according to claim 14, wherein in the adjusting step, a rate between a scheduled amount of ink ejection from the first nozzle array in the scan of the first direction and a scheduled amount of ink ejection from the first nozzle array in the scan of the second direction is caused to differ and the amount of ink ejection from the first nozzle unit is adjusted corresponding to the rate.

20. An inkjet printing method according to claim 14, wherein in the adjusting step, the amount of the ink ejection from the first nozzle unit is adjusted corresponding to an interval between the print head and a print medium.

* * * * *